United States Patent [19]

Bequette

[11] 4,153,229

[45] May 8, 1979

[54] FOLDING SCAFFOLD SUPPORT

[76] Inventor: Noah L. Bequette, P.O. Box 663, Cedar Hill, Mo. 63016

[21] Appl. No.: 853,110

[22] Filed: Nov. 21, 1977

[51] Int. Cl.[2] ..... A47G 29/02

[52] U.S. Cl. ..... 248/240.3; 248/225.4; 248/316 E

[58] Field of Search ..... 248/240.3, 225.4, 316 E, 248/316 F, 239

[56] References Cited

U.S. PATENT DOCUMENTS

| | | | |
|---|---|---|---|
| 1,450,286 | 4/1923 | Graff | 248/240.3 |
| 1,608,036 | 11/1926 | Robinson | 248/240.3 |
| 1,889,452 | 11/1932 | Porter | 248/240.3 |
| 3,119,590 | 1/1964 | Eriksson | 248/240.3 |
| 3,165,288 | 1/1965 | Jackson | 248/225.4 |

*Primary Examiner*—Robert A. Hafer

*Attorney, Agent, or Firm*—John D. Pope, III

[57] ABSTRACT

A folding scaffold support is provided which can be readily attached to walls and a plurality of which provide sturdy and safe support for a scaffold assembly. The assembly is sturdy and accepts workmen and materials so that work can safely be carried out on a structure to which a plurality of them is attached.

6 Claims, 4 Drawing Figures

FOLDING SCAFFOLD SUPPORT

This invention relates to a folding scaffold support which can be attached to buildings or vertical structures to safely support workmen and materials. A plurality of the supports accepts scaffolding components to permit ready assembly of a scaffold structure.

Among the objects of the present invention are the provision of scaffold supports which are readily attached to buildings or walls to support a scaffold assembly which supports can be easily removed and which collapse to permit efficient storage. Other objects and features will be in part apparent and in part pointed out hereinafter.

The invention accordingly comprises the constructions hereinafter described, the scope of the invention being indicated in the following claims.

Among the standard items used by workmen in carrying out work on a building is a scaffold. This may be attached to the upper part of the building and suspended to position a workman in a location where work is to be carried out. The erection and positioning of scaffolding has been a complicated and costly operation because of the steps needed to assure safety of the workmen and yet provide a moveable structure which positions the workmen at a proper locus. Many man hours are consumed in erecting scaffolding before the desired work can even be commenced. Ladders, with ladder jacks, are sometimes employed but these are dangerous.

The present invention provides a collapsable support means, a plurality of which can be quickly attached to concrete walls which still have the steel pins from their construction protruding therefrom or walls to which such steel pins are temporarily attached. Each support unit is firmly attached to the wall by utilizing the steel pins and safely supports scaffold components. When the work is completed and the scaffold components removed, the scaffold supports of the present invention can be quickly detached from the steel pins and can be collapsed for storage until subsequently needed.

In the accompanying drawings, in which one of various possible embodiments of the invention is illustrated, FIG. 1 is a perspective view showing of three of the support units of the present invention attached to a wall with planking extending across them;

The support of the present invention consists of a first channel 10 formed with a plurality of openings 12 positioned to receive the steel pins which are left in new concrete construction after the concrete has been poured, has hardened and the forms have been removed. Channel 10 is formed with a recess extending along the center of its back to accept concrete seepage along the line where the steel pins project and permit a firm attachment to the wall. This construction also adds extra strength to the channel.

Figure 2:
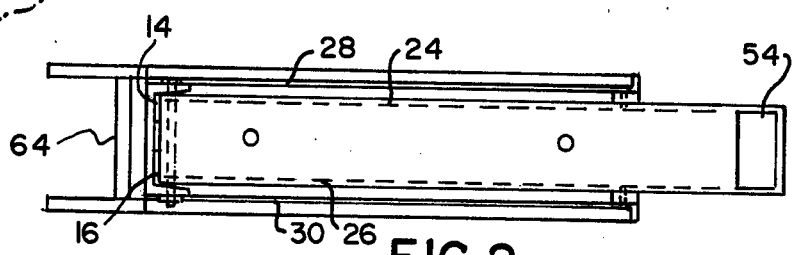
FIG. 2 is a plan of a support unit of the present invention in its collapsed position.
Figure 3:
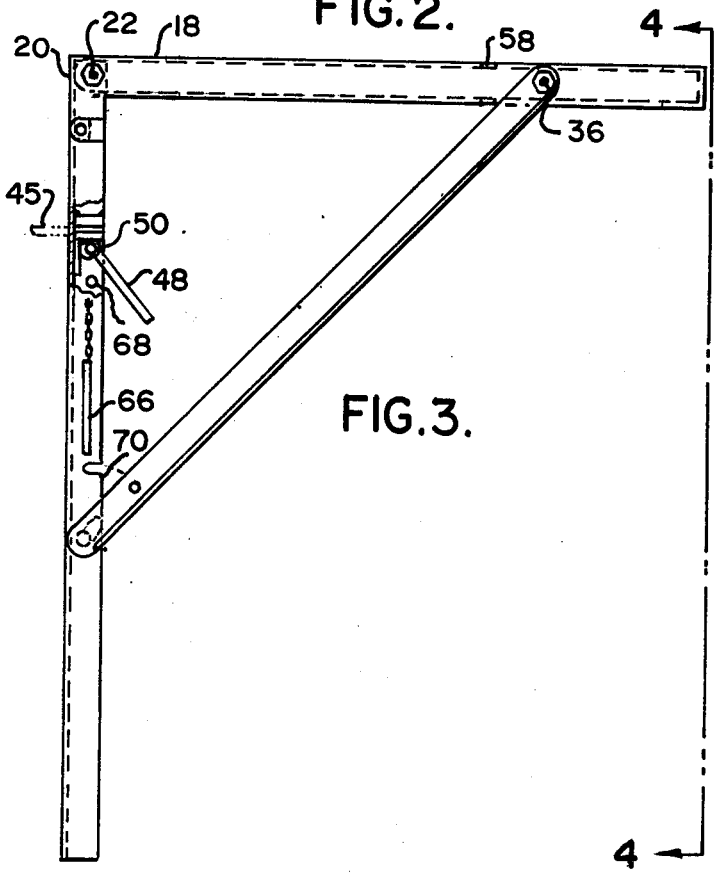
FIG. 3 is a vertical plan of the support open and attached to a wall.

A second channel 18 is attached to channel 10 at its end 20. Channel 18 is smaller in size than channel 10 so that when it is pivoted on pivot 22 toward the interior of channel 10 it nests therein. When so nested, the sides 24 and 26 of channel 18 are parallel to and inside the sides 28,30 of channel 10 while braces 32, 34 are parallel but outside sides 28, 30 (FIG. 2.). A tubing member may be substituted for channel 18 for added strength if desired.

Braces 32, 34 are pivotally attached to channel 18 at 36 and 38 so that they can be rotated, when the support is opened, for attachment to channel 10 at locking slots 40 and 42.

Channel 10 carries shim strips 14 and 16 to properly position cam lock means which include a cam butt block 44 and brace blocks 46 and 47. The cam unit also includes an operating handle 48 mounted to a serrated steel wheel 50 which is mounted on channel 10, off center. Accordingly, upon rotation by handle 48 a portion of wheel 50 is brought to bear against one of the steel pins 45 projecting through the opening 12 above wheel 50 and forces it against butt 44. This effectively locks the assembly against steel pin 45 and prevents the assembly moving until handle 48 is moved to release it.

Figure 1:
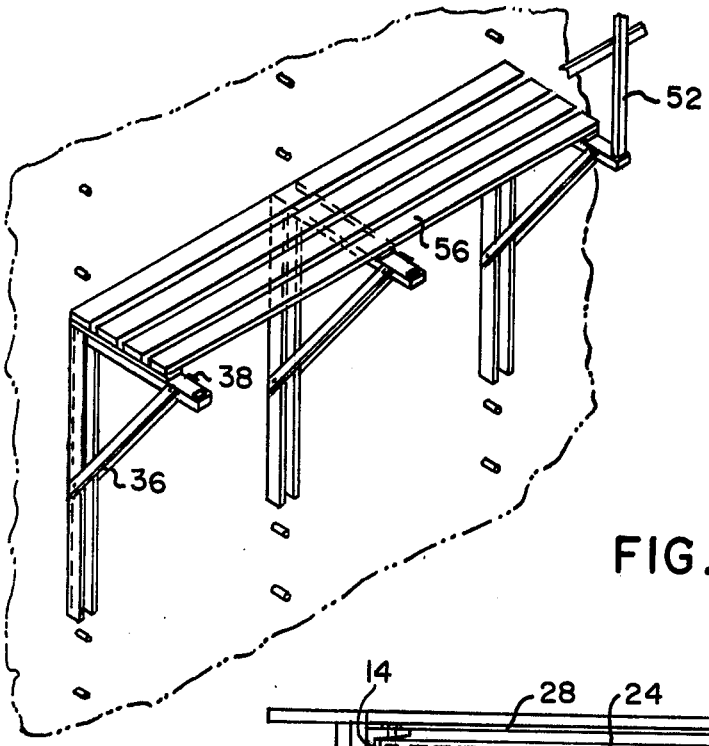

As shown in FIG. 1 a plurality of the support members can be attached to a wall and planking positioned across them which will support a workman and materials as needed to perform work on the wall. Vertical posts 52 may be inserted in openings 54 in channel 18 to support safety railing and planking 56 can be attached to two by fours held by carriage bolts to channels 18 through openings 58 therein. The planking 58 is then nailed or otherwise attached to the two by fours.

As indicated in FIG. 2 the support members of the present invention can be collapsed to occupy a minimum amount of space when not in use. When the supports are to be used, channel 18 is grasped and rotated to approximately a 90° angle from channel 10. This positions braces 32, 34 so that their ends 60, 62 can be brought adjacent locking slots 40 and 42 respectively. Locking slots 40 and 42 are preferably of the customary U-shape in order to safely hold braces 32 and 34 in position to support channel 18 in its extended position. To aid in positioning braces 32 and 34 as stated, they are preferably connected by a handle 64.

Figure 4:
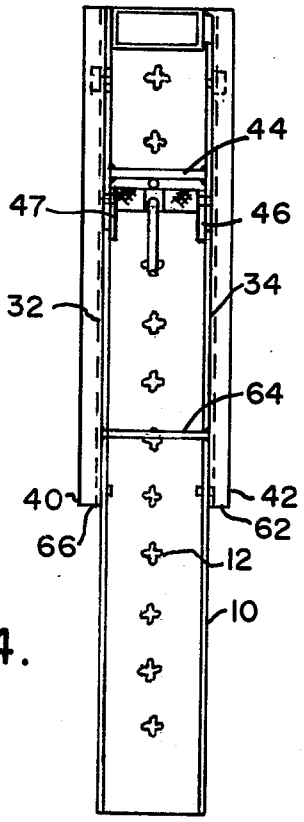
FIG. 4 is a view along the line 4—4 on FIG. 3 showing the support attached to a steel pin on a wall.

As an additional safety feature a pin 66 is suspended as by a chain from side 24. By using aligned openings 68 in sides 24 and 26, pin 66 can be inserted over handle 48 when handle 48 is in the position shown in FIG. 4 to obviate any danger of it being rotated inadvertently and thereby disengaging the support member from pin 45.

A slot 70 in each of sides 24 and 26 is positioned to receive attachments 36 and 38 when the scaffold is in a collapsed position and thereby further economize on space occupied by the collapsed unit.

In operation, a plurality of support members is attached at desired locations to projecting steel pins so that planking 56 can be supported at the desired place, each support unit is locked into place on a steel pin, the other scaffold components assembled to a plurality of the units and the assembled structure then utilized.

When it is desired to move the scaffold combination to a different location it is merely disassembled, the supports of the present invention relocated and the structure then reassembled.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A folding scaffold support comprising first and second channel members attached at their ends by pivot means so that the second channel can pivot to be disposed within the first, braces attached to the second channel by means which permit them to rotate, means at the remote ends of said braces to enable them to be attached to the first channel temporarily to position the second channel at right angles to the first, a series of elongated slot openings in the base of said first channel spaced to receive steel pins which protrude from vertically arranged construction, and cam lock means on the base of said first channel located adjacent one of said slot openings to lock said first channel to one of said steel pins and to said construction.

2. A support according to claim 1 in which the braces are interconnected.

3. A support according to claim 1 in which the first channel has locking means for attaching the braces removeably to the first channel.

4. A support according to claim 2 in which the first channel has means to accept the interconnection when the second channel is disposed within the first.

5. A support according to claim 1 in which the first channel carries means to bar the cam lock means from accidental disengagement from a steel pin against which it has been engaged.

6. A support according to claim 1 in which the second channel is a piece of tubing.

* * * * *